United States Patent [19]

Riedle et al.

[11] Patent Number: 4,993,496

[45] Date of Patent: Feb. 19, 1991

[54] QUICK RELEASE VALVE FOR SPRINKLER HEAD

[75] Inventors: Armin Riedle, Rathingen; Horst Zientek, Kaarst; Nikolaus Grainer, Odenthal-Blecher; Heinz Heider, Cologne, all of Fed. Rep. of Germany

[73] Assignee: Total Walther Feuerschutz GmbH, Cologne, Fed. Rep. of Germany

[21] Appl. No.: 463,156

[22] Filed: Jan. 8, 1990

Related U.S. Application Data

[63] Continuation of Ser. No. 206,029, Jun. 13, 1988, Pat. No. 4,898,246.

[30] Foreign Application Priority Data

| | | | |
|---|---|---|---|
| Jul. 6, 1987 | [DE] | Fed. Rep. of Germany | 3722233 |
| Jul. 22, 1987 | [DE] | Fed. Rep. of Germany | 3724215 |
| Aug. 6, 1987 | [DE] | Fed. Rep. of Germany | 3726120 |

[51] Int. Cl.[5] ..... A62C 37/14; A62C 37/10; A62C 37/11

[52] U.S. Cl. ..... 169/38; 169/37

[58] Field of Search ..... 169/37–41, 169/90, 57, 19

[56] References Cited

U.S. PATENT DOCUMENTS

| | | | |
|---|---|---|---|
| H121 | 9/1986 | Pieczykolan | 169/37 |
| 4,739,835 | 4/1988 | Polan | 169/38 |
| 4,796,710 | 1/1989 | Job | 169/38 |
| 4,898,246 | 2/1990 | Riedle et al. | 169/38 |

FOREIGN PATENT DOCUMENTS

| | | | |
|---|---|---|---|
| 3601203 | 3/1987 | Fed. Rep. of Germany | 169/37 |
| 2206489 | 1/1989 | United Kingdom | 169/38 |

*Primary Examiner*—Joseph F. Peters, Jr.
*Assistant Examiner*—James M. Kannofsky
*Attorney, Agent, or Firm*—Horst M. Kasper

[57] ABSTRACT

The invention relates to a formation of a release element, where the upper end and the lower end of a cylindrical or conical glass tube are closed by means of inwardly directed plugs.

10 Claims, 10 Drawing Sheets

QUICK RELEASE VALVE FOR SPRINKLER HEAD

CROSS-REFERENCE TO RELATED APPLICATIONS

This application is a continuation-in-part application of another application filed June 13, 1988 and bearing Ser. No. 07/206,029, now U.S. Pat. No. 4,898,246. The entire disclosure of this latter application, including the drawings thereof, is hereby incorporated in this application as if fully set forth herein.

BACKGROUND OF THE INVENTION

1. Field of the Invention

The invention relates to a release element for a thermal and/or electrical release of a fire-protection system, in particular a sprinkler system, where the release element formed from glass is filled up to bursting with a liquid.

2. Brief Description of the Background of the Invention Including Prior Art

Such release elements keep the valves in sprinkler heads closed and are to be destroyed by expansion of the bursting liquid in case of a fire. The release elements have to perform two functions. On the one hand, they have to receive the tensioning forces in order to keep the valve constantly in a closed state if there is no fire and, on the other hand, they have to burst quickly in case of a fire, such that the extinguishing process is initiated quickly. In addition, the sprinkler heads have to remain in a functioning state over decades.

In order to combine the two functions in an optimum manner, a number of release elements are known. For example, the increase of the tensioning forces by a different forming of the glass release elements has been attempted to be achieved in the U.S. Pat. No. 1,733,701 without extending the bursting time. It is further known to decrease the bursting time by inserting a displacement body inside of the bursting liquid (German Patent Application Laid Open DE-OS 3,220,124).

SUMMARY OF THE INVENTION

1. Purposes of the Invention

It is an object of the invention to provide a release element which can be produced with simple means and without large expenditures.

It is another object not to impair the requirements for sufficient stability during tensioning and for quick bursting times in case of fire.

These and other objects and advantages of the present invention will become evident from the description which follows.

2. Brief Description of the Invention

The present invention provides for a release element formed from glass for release of a fire-protection system, in particular a sprinkler system. The release element comprises a cylindrical glass tube with a thin wall thickness. An upper glass plug closes the cylindrical glass tube at its upper end. A lower glass plug is disposed and attached at the lower end of the cylindrical glass tube. A filler opening is disposed in the lower glass plug. A bursting liquid is filled into the lower glass plug to provide bursting of the release element with said liquid under specified conditions. The filler opening is hermetically closed by melting in its lower part after the filling in of the bursting liquid.

The upper glass plug and the lower glass plug can be tapered in axial direction.

The release element can be pressed against a closure piece by a counter piece in a sprinkler. The sprinkler can be provided with a sprinkler casing and with a sprinkler bow. The upper glass plug and the lower glass plug can be respectively provided with a planar face running respectively at a right angle relative to a center axis of the glass tube. The lower planar face can rest at a planar face of the closure piece of the sprinkler casing, and the upper planar face can rest at a planar face of the counter piece of the sprinkler bow.

The closure piece and the counter piece can be respectively provided with a collar. The inner faces of the collar can run parallel to the center axis of the glass tube. The outer faces of the respective plugs can rest planarly at the collar inner faces.

A curvature can be respectively provided between the outer faces and the planar faces of the release element.

One of the plugs can be provided on the outer side with a tension element, which tension element solidly spans around the plug. The tension element can be formed as a closed cap member, which cap member can be led into the region of the cylindrical tube. The cap member can be solidly connected with an elastic mass to a respective plug.

The fire protection system can be electrically released and a sprinkler system can be thermally released. The cap member can be made of a non-iron metal, such as aluminum, brass, or the like.

The counter piece and/or the closure piece can be formed as tension elements and the counter piece and/or the closure piece can solidly surround the release element with a collar. The collars can be extended up to the region of the cylindrical tube.

The plugs can be covered on their outer face with an elastic mass and can rest on the elastic mass.

The tension element can be formed as a rotating tension band which can be solidly clamped under tension in a groove of the plug. The tension band can be formed by an O-ring which can be comprised of a copper wire.

The inner space of the release element can exhibit at the upper end a semi-spherical shape and at the lower end a funnel shape.

According to the invention, the release element comprises a cylindrical glass tube having a thin wall thickness, which is closed at its upper end with a glass plug and which is provided at its lower end with a plug with a filler opening which is hermetically sealed by melting after the filling in of the bursting liquid or fluid in the lower part.

The release element can be manufactured from an easily produceable cylindrical tube, where the length is somewhat larger than the required shaft height for forming of the space for receiving the bursting liquid. The protruding ends of the glass tube can be melted to a plug without difficulties. Thus, the plugs are formed with respect to their length and strength such that the axial tensioning forces are transferred to the thin wall of the cylindrical tube piece in an optimum manner.

A cylindrical glass tube is a tube having circular cross-sections and a continuous line of center points of the circular cross-sections. A plug is a piece of glass disposed at the end of a glass tube for sealing the tube or for providing a defined port, which can be sealed by melting the glass in the port area.

Cylindrical glass tubes with melted on plugs for stabilization are known from neon tubes, such as taught in German Patent DE-PS No. 2,930,249. These glass tubes are however not filled with a bursting liquid but with an inert gas which is not provided to induce bursting of the glass body. In order to improve the fatigue limit of the release element upon axial loading, it is further disclosed that the plugs are respectively provided with a planar face running at a right angle to the center axis, where the lower planar face rests flat at a planar face of a closure piece of the sprinkler casing and where the upper planar face rests flat at a planar face of a counter piece of the sprinkler wing.

In this manner it is achieved that the cylindrical shaft portion of the release element with the thin wall face is only impinged by pressure forces such that this sensitive portion remains free from all bending and shearing tensions.

In order to improve the application of the axial forces to the center cylindrical portion of the release element, it is further disclosed that the closure piece and the counter piece are respectively provided with a collar, where the inner faces of the collar run parallel to the center axis such that the outer faces of the plugs can rest thereon in a planar fashion.

In order that the transition locations do not experience increased tensions between the cylindrical outer faces of the plugs and the planar faces running thereto at a right angle, it is disclosed that at these locations a curvature is provided in each case. A further improvement of the fatigue limit of the release element upon axial loading is achieved by providing the plugs on the outer face respectively with a tension element, which solidly span around the plug.

By the use of tension elements it is achieved that the plugs can absorb shearing forces without damage to the release element and that the cylindrical shaft part of the release elements with the thin wall face is thus only impinged by pressure forces such that this sensitive part remains free of any bending or shearing tensions.

In order to improve the application of the axial forces onto the center cylindrical part of the release element, it is furthermore disclosed that the tension elements are provided as closed caps and/or cap rings, which are led up to the region of the cylindrical tube, whereby the caps or cap rings can be solidly connected with the plugs by way of an elastic mass.

According to the invention the release member is fabricated out of a pre-produced cylindrical glass tube with overlength, which are dimentioned such that at the two ends of the glass tube in each case a glass plug can be molten inwardly and thereby the cylindrical outer face is retained over the full length of the release member. The funnel shaped plug exhibits at its outside a conditioned shoulder, which forms a shoulder angle alpha relative to the longitudinal axis of from about 30° to 45°. The plug is further furnished with an internal nearly planar floor face.

The features allow to produce a release member with substantially thin wall faces onto which only pressure forces are exerted. The formation of the plugs effect that the forces are initiated in the plug with the fill opening without bad effects onto the glass tube.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
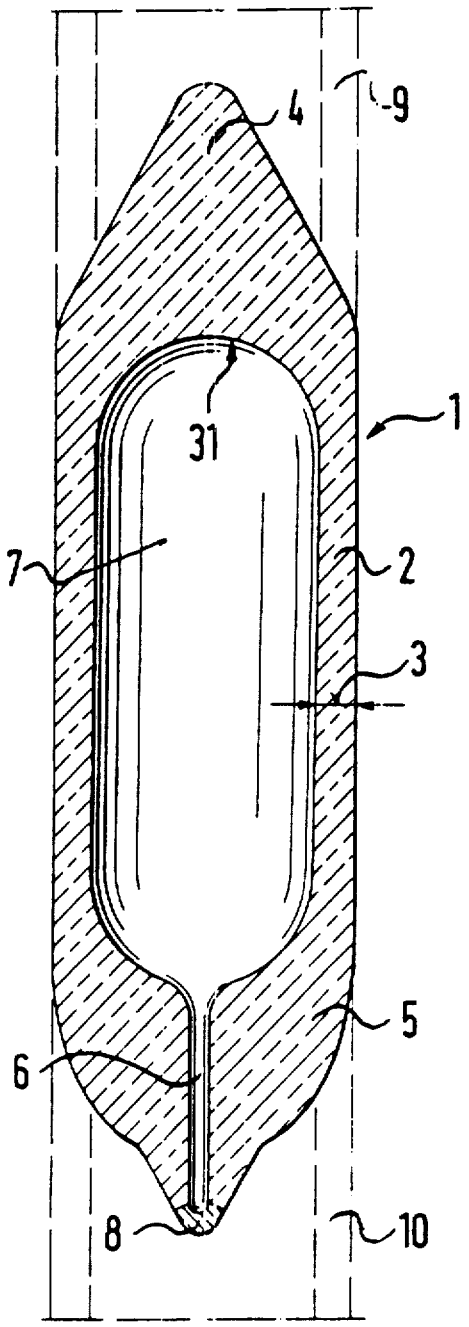
FIG. 1 is a cross-sectional view of a release element.

In accordance with the present invention, there is provided a release element for thermal and/or electrical release of a fire-protection system, in particular a sprinkler system. The release element, formed from glass, is filled to its bursting with a liquid. The release element 1 comprises a cylindrical glass tube 2 with a thin wall thickness 3. The glass tube 2 is closed at its upper end by means of a glass plug 4 and is provided at its lower end with a plug 5 and a filler opening 6. The lower part 8 of the glass tube 2 is hermetically closed by melting after the filling of the bursting liquid into the inner chamber 7.

The plugs 4, 5 can be tapering in axial direction. The release element 1 can be pressed against a closure piece 14 by a counter piece 15 in a sprinkler 11. The plugs 4, 5 can be respectively provided with a planar face 17, 18 running respectively at a right angle relative to the center axis 39. The lower planar face 18 can rest at a planar face 23 of the closure piece 14 of the sprinkler casing 12. The upper planar face 17 can rest at a planar face 24 of the counter piece 15 of the sprinkler bow 13. The closure piece 14 and the counter piece 15 can be respectively provided with a collar 25, 26. The inner faces 27, 28 of the collar can run parallel to the center axis 39. The outer faces 19, 20 of the plugs 4, 5 can rest planarly at the collar inner faces 27, 28. A curvature 21, 22 can be provided respectively between the outer faces 19, 20 and the planar faces 17, 18 of the release element 1. The plugs 4, 5 can be respectively provided on the outer side with a tension element which can solidly span around the plugs. The tension elements can be formed as closed caps 33 and/or cap rings 34, which are led into the region of the cylindrical tube projection 10. The caps 33 or the cap rings 34 can be solidly connected with an elastic mass 35, 36 to the plugs 4, 5. The caps 33 and the cap rings 34 can be made of a non-iron metal, such as aluminum, brass, or the like.

The plugs 4, 5 can be respectively provided on the outer side with a tension element which can solidly span around the plugs. The counter piece 15 and/or the closure piece 14 can be formed as tension elements and can solidly surround the release element 1 with a collar 25. The collars 25, 26 can extend up to the region of the cylindrical tube projection 10. The plugs 4, 5 can be covered on their outer face with an elastic mass 35, 36 on which the pieces 4, 5 can rest. The tension element can be formed as a rotating tension band 37 which can be solidly clamped under tension in a groove 38 of the plug 4, 5. The tension band 37 can be formed by an 0-ring comprised of a copper wire. The inner space 7 of the release element 1 can exhibit at the upper end a semi-spherical shape 31 and at the lower end a funnel shape 32.

The release element 1 is formed from a cylindrical glass tube 2 having a thin wall thickness 3. The end projections 9 and 10 of the glass tube 2 are melted down to plugs 4 and 5. The plug 5 is provided with a filler opening 6, which is hermetically sealed at the end 8 by melting after the filling in of the bursting liquid into the inner space 7.

Figure 2:
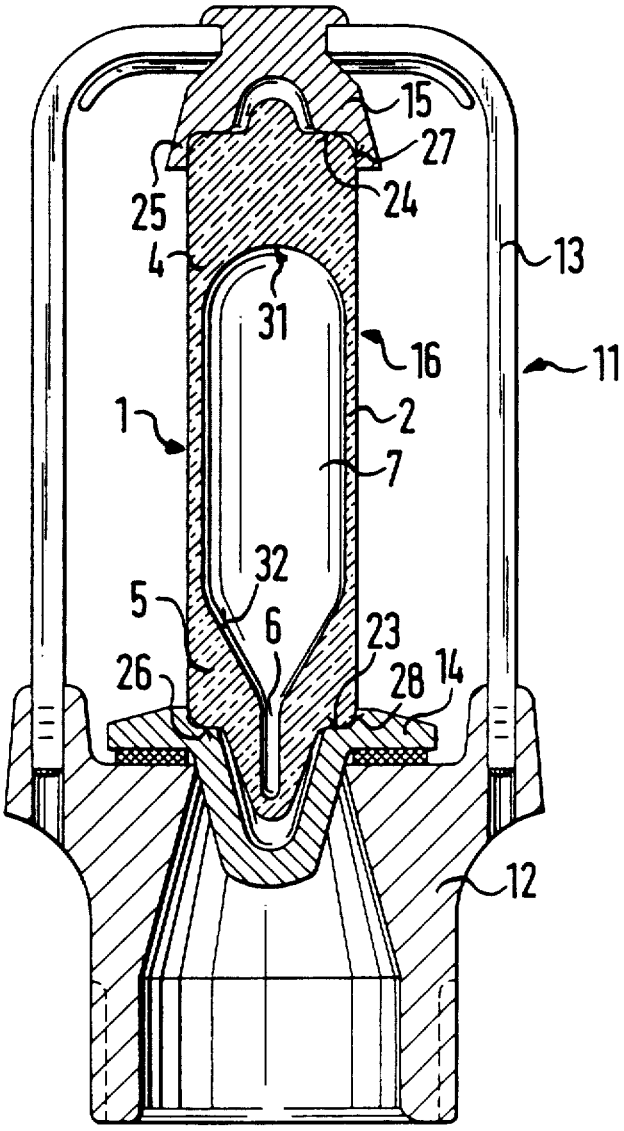
FIG. 2 is a cross-sectional view of a sprinkler with the release element.

FIG. 2 illustrates a sprinkler 11 with a sprinkler casing 12 and a sprinkler bow 13 with a spray dish, not designated in detail. The sprinkler 11 is closed by the release element 1 and a closure piece 14, where the release element 1 rests at the other end against a counter piece 15. Based on provisions, not illustrated, the release element 1 is kept under pressure such that the closure piece 14 rests sealingly on the sprinkler casing.

The release element 1 comprises a center cylindrical tube part 16 with a thin wall thickness and two plugs 4 and 5, where the lower plug 5 is provided with a filler opening 6, which was closed at the end 8 after the filling in of the bursting liquid into the inner space 7. At the upper end, the inner space 7 is formed as a semi-sphere 31 and, at the lower end, the inner space 7 is formed as a funnel 32.

In order for the closing forces acting on the release element 1 to exert only axial pressure forces onto the center cylindrical tube piece 16, there are provided planar faces 17 and 18 in the region of the plugs 4 and 5, which planar faces 17 and 18 run at a right angle to the center axis 39 of the release element 1. Curvatures 21 and 22 are provided between these planar faces 17 and 18 and the cylindrical outer faces 19 and 20 of the plugs 4 and 5. The release element 1 rests with its planar face 18 on a planar face 23 of the closure piece 14. The planar face 17 rests against a planar face 24 of the counter piece 15. In order to avoid bending and shearing forces, the closure piece 14 and the counter piece 15 are respectively provided with a collar 25 and 26, which collars exhibit inner planar faces 27 and 28 running parallel to the center axis 39 of the release element 1 such that the cylindrical outer faces 19 and 20 of the plugs 4 and 5 rest flatly at the inner faces of the collars 25 and 26.

Figure 4:
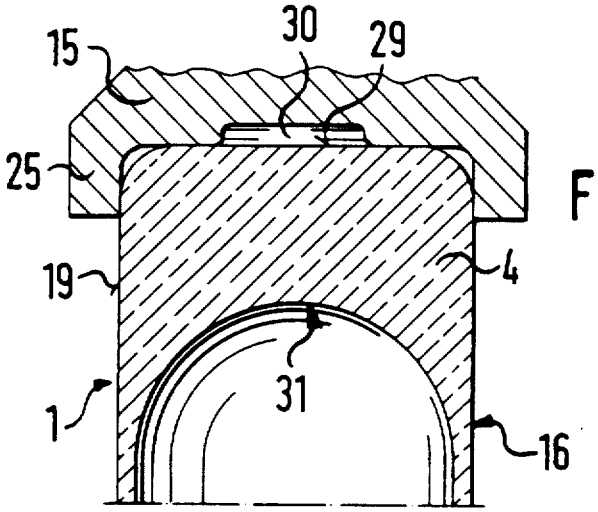
FIG. 4 is a sectional view of a further embodiment of the upper part of the release element.
Figure 3:
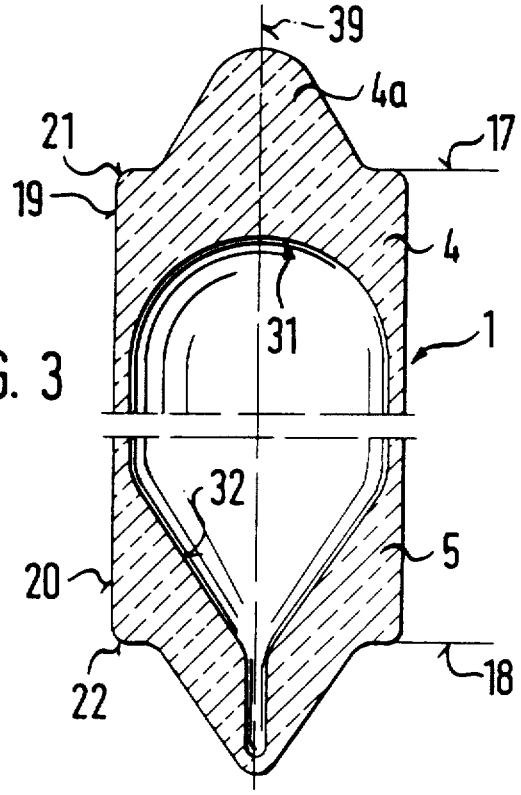
FIG. 3 is an enlarged sectional illustration of the release element.

The embodiments illustrated in FIGS. 2 and 3 show the release element 1 in the region of the plug 4 as provided with an upper reinforcement part 4*a*. This part 4*a* can be dispensed with, as illustrated in FIG. 4, such that a continuous planar surface 29 is generated. In order to transfer pressure forces in the plug 4 only in the plug's outer region, the counter piece 15 is provided in its center part with a center recess 30.

Figure 5:
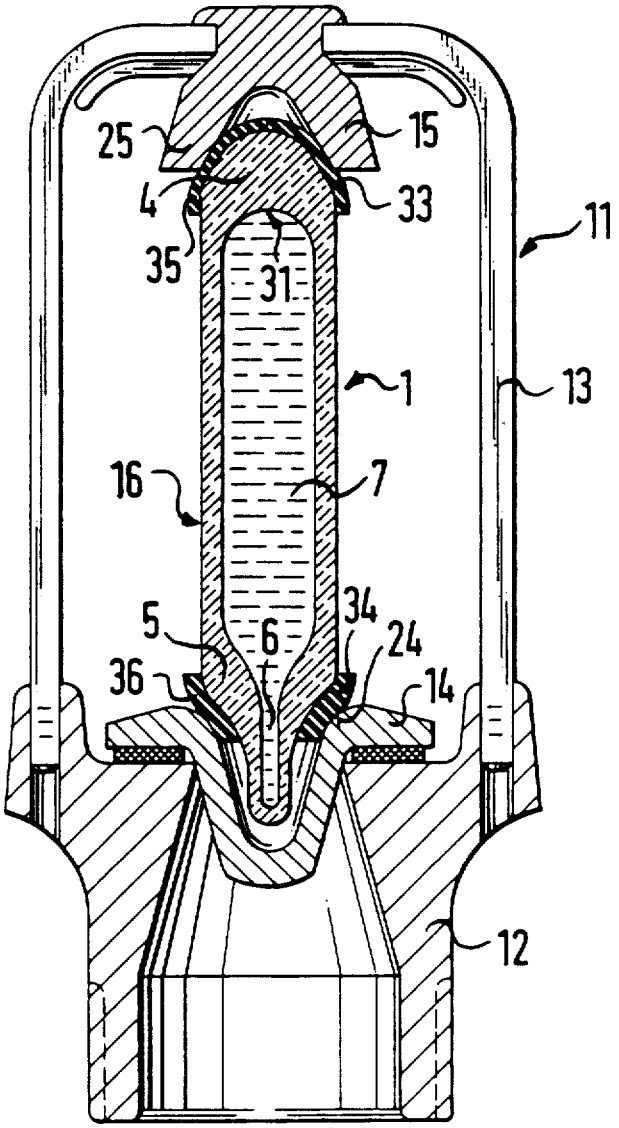
FIG. 5 is a cross-sectional view of a sprinkler with a further release element.
Figure 6:
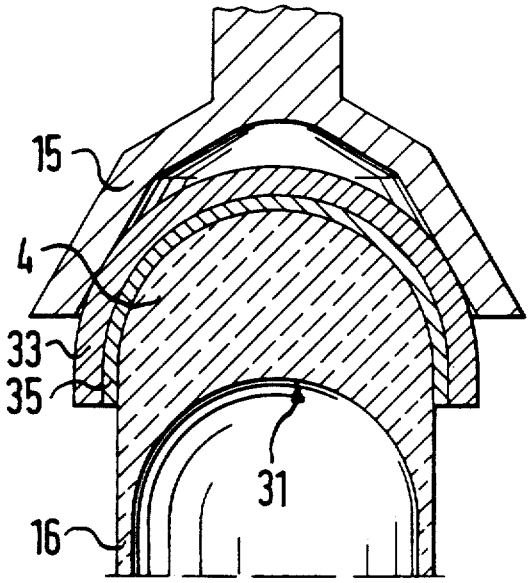
FIG. 6 is a sectional view, on an enlarged scale, of the release element with cap and counter piece.
Figure 7:
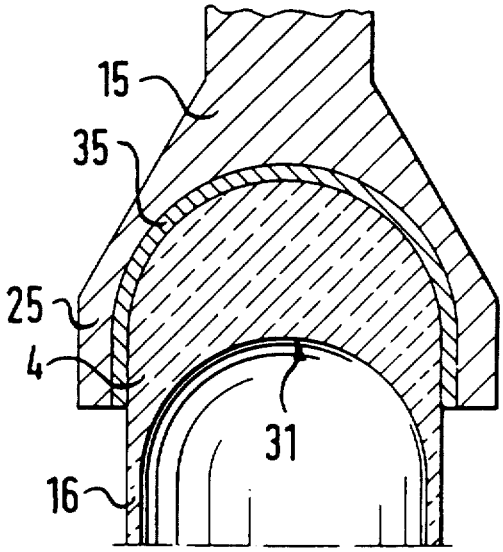
FIG. 7 is a sectional view, on an enlarged scale, of the release element with counter piece as cap.

In order for the closure forces acting on the release element 1 for exerting axial pressure forces onto the center cylindrical tube piece 16, the plugs 4 and 5 are respectively provided with a tension element which solidly spans around the plugs 4 and 5, as illustrated in FIG. 5. These tensions elements can be provided as a closed cap 33 or as a cap ring 34, which are connected solidly to the plugs 4, 5 with a plastic or elastic mass 35, 36. A cap member can be a cap or a cap ring. The cap and cap ring are provided from aluminum, brass, or the like for reasons of preventing corrosion. It is part of the invention, for reasons of substitution that the closure piece 14 and/or the counter piece 15 can be formed as a tension element and thereby the closure piece 14 and/or the counter piece 15 surround the release element 1 solidly with a collar 25, 26 extended up to the region of the cylindrical tube piece 16 Here again, there is respectively provided an elastic mass 35, 36 between the release element 1 and the parts 14, 15.

Figure 8:
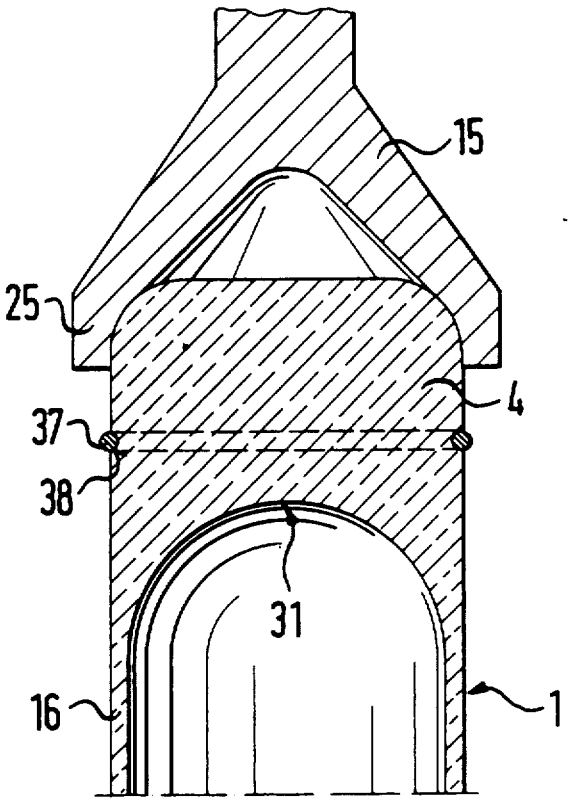
FIG. 8 is a sectional view of the release element with tension band as tension element.

FIG. 8 illustrates a tension element formed as a tension band 37, which is solidly tensioned as an O ring in a groove 38 of the plug 4, 5. This tension band 37 can accept shearing forces such that the thin cylindrical tube piece 16 remains free of bending and shearing tensions.

The filler opening 6 can have a diameter which is from about 0.2 to 0.6 of the thickness of the wall of the glass tube 2. The thickness of the plug 4 or 5 can be from about 2 to 6 times the thickness of the tube wall and is preferably from about 3 to 5 times the thickness of the tube wall. The thickness of the tube wall can be from 1/10 to about ¼ of the inner diameter of the tube. The plugs 4 can be formed on their inner side substantially spherical and on their outer side in a funnel shape. The cone angle at the tip of the cone can be from about 50 to 90 degrees and is preferably from about 60 to 70 degrees. The planar face 24 can be of annular shape, where the width of the annular part is from about 1/5 to ⅓ of the outer diameter of the tube. The planar face 23 can be formed as an annular ring having a width of from 1/10 to 1/5 of the outer diameter of the tube. The elastic mass 35, 36 can have a thickness from about 0.5 to the wall thickness of the glass tube.

The release member, formed of glass, is filled with a liquid for bursting of the release member. The release member comprises a cylindrical center part with a thin wall thickness. Said release member is closed at the upper end by way of a glass plug, rounded on the outside, and is provided at the lower end with a glass plug with a fill-in opening which becomes thinner in axial direction. The fill-in opening is molten down after the filling-in of the bursting fluid in the lower part. The release member 41 is made of a pre-produced cylindrical glass tube with overlength shoulders 49. The shoulders are dimensioned such that from these in each case a glass plug 44, 45 can be molten inwardly at the two ends of the glass tube. The cylindrical outer face is retained over the full length of the release member 41. The funnel-shaped plug 45 exhibits a shoulder 49 at the outside. The shoulder 49 forms a shoulder angle alpha relative to the longitudinal axis 50 of from about 30° to 45° and wherein the plug 44 is furnished with an internal, substantially planar floor 51.

The release member 41 can have an outer diameter 57, of equal to or less than 5 mm and exhibits a wall thickness 43 of from about 0.8 to 0.5 mm with a tolerance of ±0.02 to 0.03 mm. The inwardly directed glass plug 45 can 20 exhibit a wall thickness 58 of from about 1.5 to 2.0 times the wall thickness 43. The wall thickness can be measured along a line 59 disposed at a right angle relative to the transition shoulder 49 and starting from an internal point 60. Said internal point is determined by a cross sectional face 61 of from about 60 to 85% as referred to the inner diameter 62.

The center part of the glass tube 42 can exhibit a length 63 of from about 18 to 22 mm with a total length 64 of the release member 41 of from between 25 and 29 mm.

The release member 41 can exhibit an outer diameter of 5 mm. A release member 41 can also have an outer diameter of 4 mm, and be furnished with a plug 44 with a cylindrical section 52. The length 53 of the cylindrical section 52 can correspond to the outer diameter of the cylindrical glass tube 42.

The release member 41 made of glass is filled with a liquid for bursting of the release member. The release member is formed out of a glass tube 42*a* with a thin wall thickness 43. The glass tube 42*a* is closed at the upper end by way of a glass plug 44 and is provided at the lower end with a plug 45 with a fill in opening 46. The fill in opening 46 is molten closed in the lower part 48 after the filling in of the bursting fluid 47. The glass tube 42*a* is formed of conical shape. The narrowing is a linear function running from the plug 44 to the plug 45. The plug 44 having a planar floor section 51, exhibits in the region of its largest diameter an outer diameter of substantially 5 mm. The height 54 of the plug corresponds substantially to this outer diameter.

The plug 44 can be rounded on the outside. The plug 44 can exhibit on the outside a planar floor section 55. The planar floor section 55 can exhibit a transition into a rounding 56.

The release member made of glass is filled with a liquid for bursting of the release member. The release member 41 comprises a cylindrical center part with thin wall thickness. The cylindrical center part is closed at its upper end by way of an outwardly rounded glass plug 44. Said cylindrical center part is furnished at its lower end with a glass plug 45 with fill-in opening 46. Said glass plug narrows in an axial direction. The lower plug with fill-in opening is molten after the filling-in of the bursting fluid 47 in the lower section 48. The release member 41 is furnished out of a prefabricated cylindrical glass tube 42 with overlength shoulder 49. Said glass tube 42 is dimensioned such that, in each case at the two ends of the glass tube 42. A glass plug 44, 45 can be molten inwardly The cylindrical outer face is thereby retained over the full length of the release member 41. The funnel shaped plug 45 exhibits at the outside a transition shoulder 49, which forms a shoulder angle alpha relative to the longitudinal axis 50 or from about 30 to 40 degrees, and wherein the plug 44 is furnished with an internal, substantially planar floor section 51.

Figure 9:
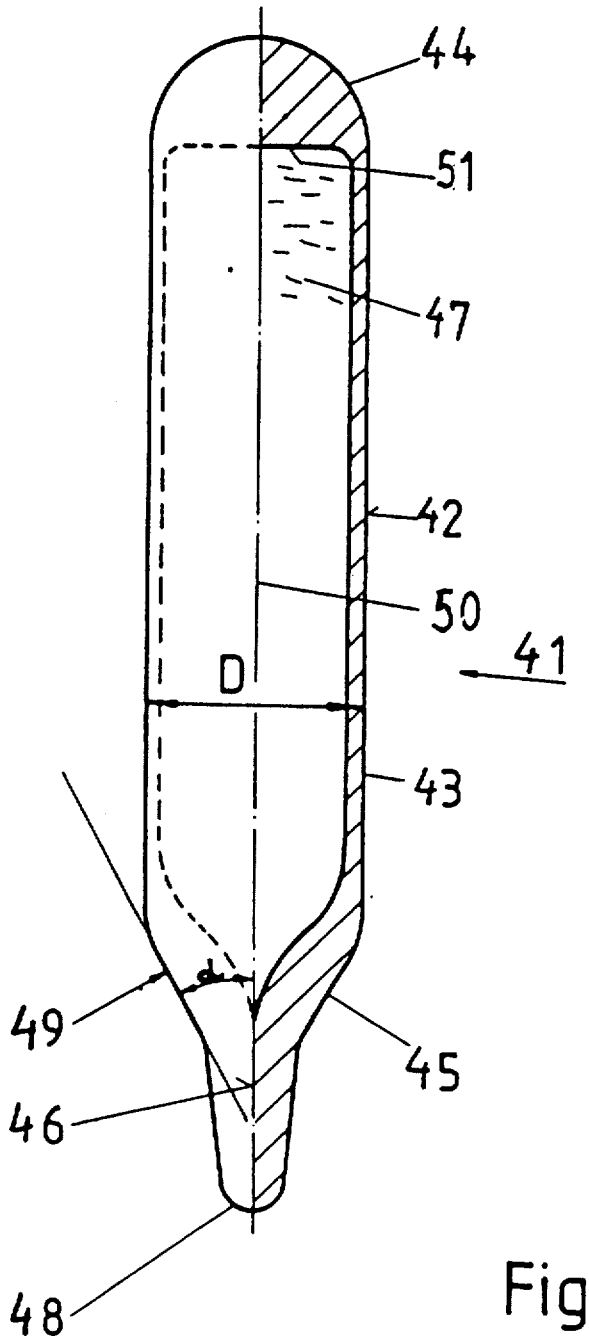
FIG. 9 is a sectional view of a release member of about 5 mm outer diameter.

The release member, according to FIG. 9, has an outer diameter D of 5 mm. The release member 41 comprises a cylindrical glass tube part 42 with a very thin wall thickness 43 and an upper plug 44 and a lower plug 45, where the thickening regions are directed inwardly.

The lower plug 45 is formed in axial direction, becoming thinner in downward direction, and is furnished with a central fill-in opening 46. After filling in of the bursting fluid 47, the lower part 48 is molten down. The plug 45 exhibits in its outer part a transition shoulder 49, which forms a shoulder angle alpha relative to the longitudinal axis 50 from about 30° to 45° and which is preferably from about 35° to 40°. The plug 44 is rounded on the outside and furnished with an internal planar floor 51.

Figure 10:
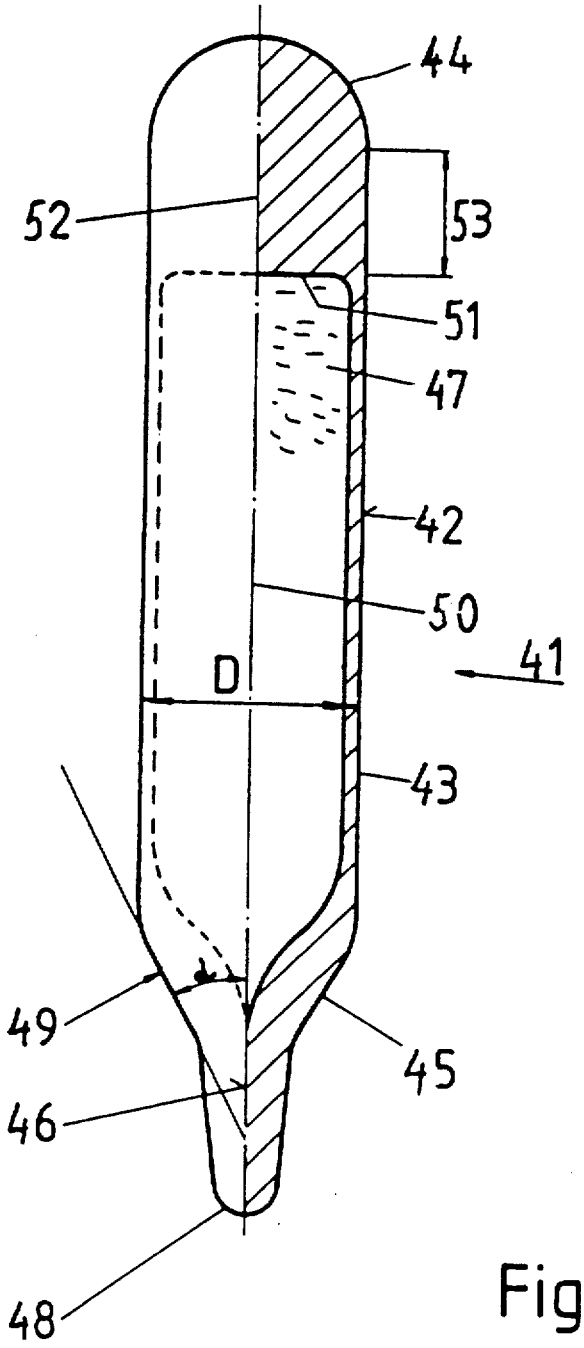
FIG. 10 is a sectional view of a release member with a diameter of about 4 mm.

FIG. 10 illustrates a release member 41 with an outer diameter D of about 4 mm. In order to feed in the forces exerted by the spinkler casing without damaging of the cylindrical glass tube part 42 these forces are fed into the plug 45. For this purpose the plug 44 is furnished with a cylindrical part 52 where the length 53 of the cylindrical part 52 corresponds to the diameter D.

Figure 11:
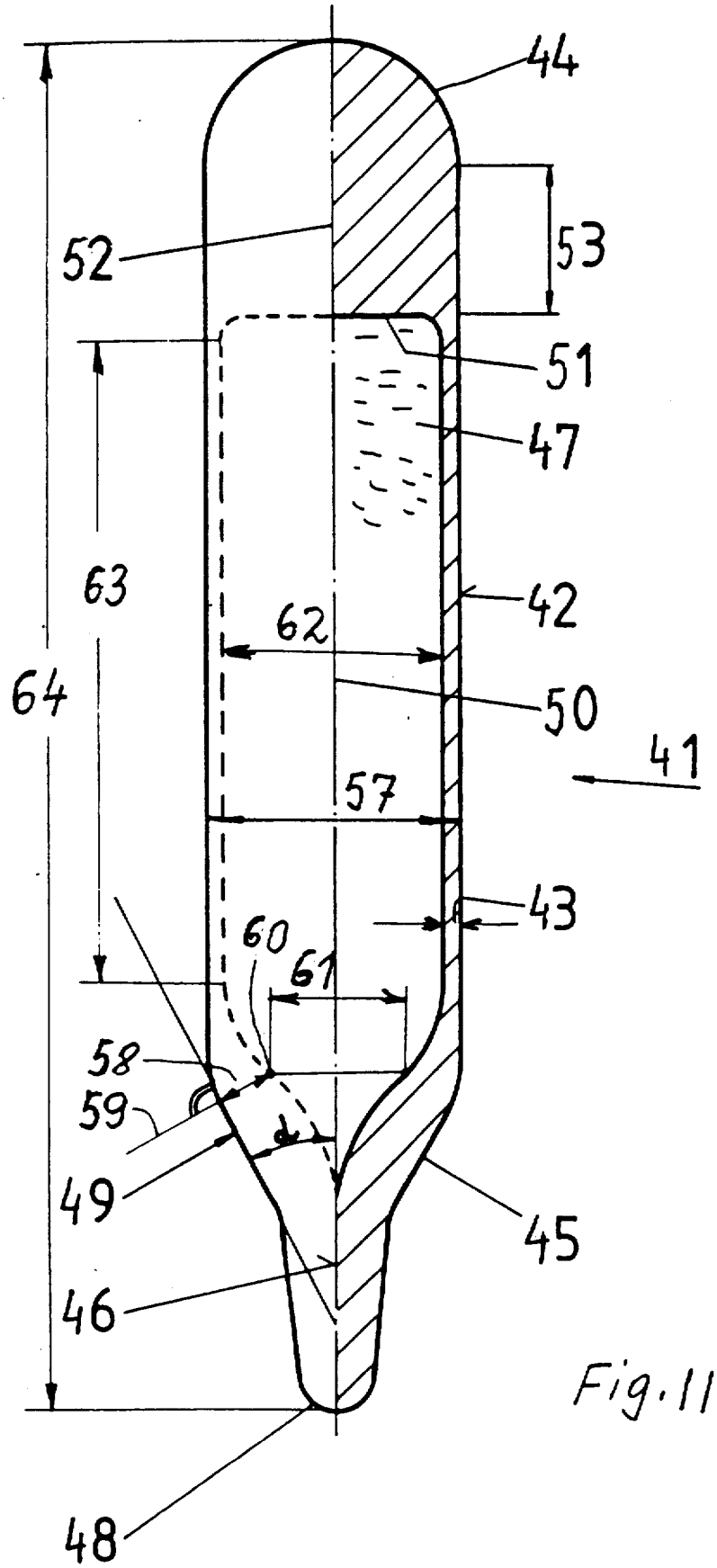
FIG. 11 illustrates particular features of the invention.

The outer diameter is designated in FIG. 11 with 57. The wall thickness 58 of the plug 45 amounts to about 1.5 to 2.0 times the wall thickness 43. The wall thickness 58 is measured along a line 59 which is aligned at a right angle relative to the transition shoulder 49 and which line 59 passes through a point 60. The point 60 is determined by a cross-sectional face 61, which amounts to from about 60 to 85% relative to the inner diameter 62.

Figure 12:
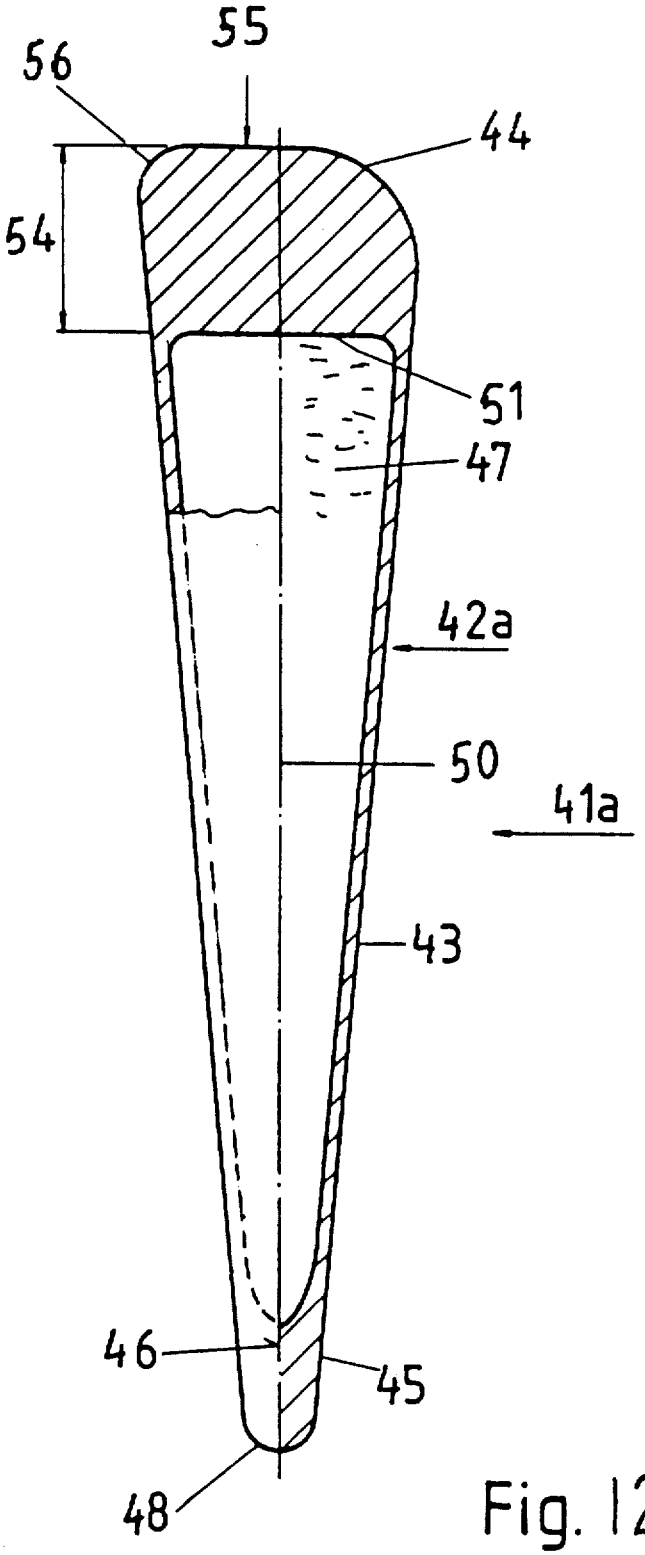
FIG. 12 represents a further embodiment of the invention.

FIG. 12 illustrates a further embodiment of the release member according to the invention which is designated in this case with 41*a*. The glass tube 42*a* is formed conical, wherein the narrowing and thinning runs from the upper plug 44 to the lower plug 45. In this case as well, the individual fill in opening 46 is furnished in the region of the plug 45 and is molten down in the lower part 48, also after filling in of the bursting fluid 47. The plug 44 with its internal substantially planar floor face 51 and its total height of 54 can either be formed with an outer rounding such as illustrated in FIGS. 9 and 10 or it can be furnished with a planar floor part 55, which then transfers into a round section 56.

The glass tubes used in the context of the present invention are machine manufactured glass tubes. These glass tubes have features which distinguish them from blown glass parts such as blown cylindrical barrels. Such differences between blown material and machine produced material are recognized by persons skilled in the art based on consideration of optical properties. For example, the thickness of the wall of machine produced glass tubes is substantially more uniform than the wall of a blown glass tube or glass barrel. Consequently, the more uniform wall thickness allows to produce safety elements of higher quality an average lower wall thickness and increased reliability for the release moment and the release conditions of such a valve. Furthermore, the machine produced glass tubes employed are distinguished from conventional blown materials by a lesser amount of scars, cicatrice, grooves, scores, flutes and recesses, Furthermore molded glass materials allow observation of molding seams. These features allow distinction of conventional glass tubes from those employed advantageously according to the present invention.

It will be understood that each of the elements described above, or two or more together, may also find a useful application in other types of release elements differing from the types described above.

While the invention has been illustrated and described as embodied in the context of a release element for the thermal and/or electrical release of a fire protection system, such as a sprinkler system; it is not intended to be limited to the details shown; since various modifications and structural changes may be made without departing in any way from the spirit of the present invention.

Without further analysis the foregoing will so fully reveal the gist of the present invention that others can, by applying current knowledge, readily adapt it for various applications without omitting features that from the standpoint of prior art, fairly constitute essential characteristics of the generic or specific aspects of this invention.

What is claimed as new and desired to be protected by Letters Patent is set forth in the appended claims.

1. A release member for thermal and/or electrical release of a fire protection plant, in particular for a sprinkler plant, wherein the release member, formed of glass, is elongated along a longitudinal axis, has an inside and an outside, and is filled with a liquid for bursting the release member, and wherein the release member comprises a cylindrical center part with an inner diameter and an outer diameter, a thin first wall thickness; a cylindrical inner face and a cylindrical outer face which release member is closed at an upper end by way of a first glass plug, rounded on the outside, and is provided at a lower end with a second glass plug with a fill-in opening which becomes thinner in axial direction, where the fill-in opening is melted down after the filling in of the bursting fluid in the lower end, wherein the release member (41) is made of a pre-produced cylindrical glass tube with overlength shoulders, which are dimensioned such that from these, in each case, the glass plugs (44, 45) are melted inwardly at the two ends of the glass tube, and wherein the cylindrical outer face is retained over the full length of the release member (41) and wherein the second plug (45) is funnel-shaped and exhibits a transition shoulder (49) at the outside, which shoulder (49) forms a shoulder angle alpha relative to the longitudinal axis (50) of from about 30° to 45° and wherein the first plug (44) is furnished with an internal, substantially planar floor (51).

2. The release member according to claim 1 wherein the outer diameter (57), is equal to or less than 5 mm, and the first a wall thickness (43) is of from about 0.8 to 0.5 mm with a tolerance of ±0.02 to 0.03 mm; and wherein the funnel-shaped glass plug (45) exhibits a second wall thickness (58) of from about 1.5 to 2.0 times the first wall thickness (43), which second wall thickness is measured along a line (59) disposed at a right angle relative to the outside of the transition shoulder (49) and starting from a point (60) on the inside which is located on a cross sectional face (61) that has an internal diameter of from about 60 to 85% of the inner diameter (62) of the center part.

3. The release member according to claim 1 wherein the cylindrical center part of the glass tube (42) exhibits a length (63) of from about 18 to 22 mm with the full length (64) of the release member (41) of from between 25 and 29 mm.

4. The release member according to claim 1 wherein the outer diameter is 5 mm.

5. The release member according to claim 1, wherein the outer diameter is 4 mm, and the first plug (44) has a cylindrical section (52) with a length (53) equal to the outer diameter of the cylindrical glass tube (42).

6. A release member for thermal and/or electrical release of a fire protection plant, in particular a sprinkler plant, wherein the release member (41) is made of glass, has an inside and an outside, and is filled with a liquid for bursting the release member, wherein the release member is formed out of a glass tube (42*a*) with a thin wall thickness (43), which glass tube (42*a*) is closed at an upper end by way of a first glass plug (44) and is provided at a lower end with a second plug (45) with a fill-in opening (46), which fill-in opening (46) is melted closed in the lower end (48) after the filling in of the bursting fluid (47), wherein the glass tube (42*a*) is formed of conical shape, wherein the narrowing is a linear function running from the first plug (44) to the second plug (45), and wherein the first plug (44) having a planar floor section (51) and exhibits in a region of its largest diameter an outer diameter of substantially 5 mm, and wherein the first plug has a height (54) that corresponds substantially to the outer diameter.

7. The release member according to claim 6, wherein the first plug (44) is rounded on the outside.

8. The release member according to claim 6 wherein the first plug (44) exhibits on the outside a planar floor section (55) which exhibits a transition into a rounding (56).

9. A release member for a thermal and/or electrical release of a fire protection plant, in particular a sprinkler plant, wherein the release member is made of glass, is elongated along a longitudinal axis, has an inside and an outside, and is filled with a liquid at an inner space for bursting the release member, wherein the release member is made of a cylindrical center part with thin wall thickness, which cylindrical center part is closed at an upper end by way of a first glass plug and which cylindrical center part is furnished at a lower end with a second glass plug with a fill-in opening, which fill-in opening, after the filling in of the bursting fluid, is melted down in the lower part; and wherein the release member is furnished out of a pre-fabricated cylindrical glass tube with a cylindrical outer face and overlength shoulders which shoulders are dimensioned such that in each case the glass plugs are melted in an inward direction at the two ends of the glass tube from the shoulders, and wherein the cylindrical outer face is retained over the full length of the release member, and wherein the inner space of the release member exhibits at its upper end a substantial planar floor face and at its lower end a funnel face, wherein the shoulder at the second plug (45) is a transition shoulder (49) which forms a shoulder angle relative to the longitudinal axis (50) of from about 30 to 40 degrees.

10. A release member for thermal and/or electrical release of a fire protection plant, in particular a sprinkler plant, wherein the release member is made of glass, is elongated along a longitudinal axis, has an inside and an outside, and is filled with a liquid for bursting of the release member, and wherein the release member (41) comprises a cylindrical center part with thin wall thickness, which cylindrical center part is closed at an upper end by way of an outwardly rounded first glass plug (44), and which cylindrical center part is furnished at a lower end with a second glass plug (45) with a fill-in opening (46) which second glass plug narrows in an axial direction, which lower second plug with fill-in opening is melted after the filling-in of the bursting fluid (47) in the lower end (48), wherein the release member (41) is furnished out of a prefabricated cylindrical glass tube (42) with a cylindrical outer face and overlength shoulders (49), which glass tube (42) is dimensioned such that, in each case, at the two ends of the glass tube (42), the glass plugs (44, 45) are melted inwardly from the shoulders, and wherein the cylindrical outer face is thereby retained over the full length of the release member (41), and wherein the second plug (45) is funnel-shaped and the shoulder at the outside of the second plug is a transition shoulder (49), which forms a shoulder angle alpha relative to the longitudinal axis (50) of from about 30 to 40 degrees, and wherein the first plug (44) is furnished with an internal, substantially planar floor section (51).

* * * * *